US006922849B1

(12) United States Patent
Fedrick

(10) Patent No.: US 6,922,849 B1
(45) Date of Patent: Aug. 2, 2005

(54) MAN'S TROUSER

(76) Inventor: Melvin Fedrick, 8313 Dahlia Ave. #3, Tampa, FL (US) 33619

( * ) Notice: Subject to any disclaimer, the term of this patent is extended or adjusted under 35 U.S.C. 154(b) by 0 days.

(21) Appl. No.: 10/887,564

(22) Filed: Jul. 9, 2004

Related U.S. Application Data

(60) Provisional application No. 60/485,648, filed on Jul. 9, 2003.

(51) Int. Cl.[7] ..... A41D 13/02
(52) U.S. Cl. ..... 2/227
(58) Field of Search ..... 2/311–314, 303, 2/304, 326, 338, 227, 240, 76, 77, 78.3, 115, 78.1, 79, 229, 300, 236, 237, 403

(56) References Cited

U.S. PATENT DOCUMENTS 5,010,595 A * 4/1991 Stradley ..... 2/227
5,168,582 A * 12/1992 Aldridge ..... 2/305
5,289,590 A * 3/1994 Larson ..... 2/227
5,689,832 A * 11/1997 Head ..... 2/227
6,308,338 B1 * 10/2001 Caldwell ..... 2/312

* cited by examiner

*Primary Examiner*—Tejash Patel
(74) *Attorney, Agent, or Firm*—Kenneth L Tolar

(57) ABSTRACT

A man's trouser comprises a pelvic section having a pair of leg portions depending therefrom. The pelvic section includes a waist section having an upper circumferential edge with a lower continuous elastomeric band secured thereto. An upper, elastomeric waistband is secured to an upper edge of the lower band and includes belt loops positioned thereon for receiving a belt to suspend the trouser on a wearer. Both bands are configured to resemble an undergarment waistband so that the garment appears to be a conventional trouser suspended below the wearer's undergarment waistband.

4 Claims, 1 Drawing Sheet

MAN'S TROUSER

CROSS REFERENCE TO RELATED APPLICATIONS

This application entitled to the benefit of provisional application No. 60/485,648 filed on Jul. 9, 2003.

BACKGROUND OF THE INVENTION

1. Technical Field of the Invention

The present invention relates to a man's trouser having a pair of integral elastomeric undergarment waistbands protruding upwardly from the trouser waist section to simulate the trouser slipping below the wearer's underwear.

2. Description of the Prior Art

It is considered fashionable for certain people, particularly young boys, to wear trousers well beneath the waistline to expose an upper portion of the wearer's underpants. However, wearing pants in such a manner can be uncomfortable in that the pants are continuously pulling down the wearer's underwear. Additionally, when the pants are in such a position, they are susceptible to falling down further than desired.

Accordingly, there is currently need for a trouser that allows a user to invoke such a style without incurring the aforementioned problems. The present invention satisfies this need by providing a uniquely designed trouser having a pair of elastomeric bands upwardly protruding from the waist portion; the bands each resemble an undergarment waistband so as to give the appearance of a conventional trouser being worn below an undergarment waistband.

SUMMARY OF THE INVENTION

The present invention relates to an improved trouser. The device comprises a trouser member having a pair of elongated legs portions depending from a pelvic section. The pelvic section includes a waist section that terminates at an upper, circumferential edge. Attached to the upper edge of the waist section is a lower elastomeric band configured to resemble an undergarment waistband. The lower elastomeric band includes a continuous upper edge having a continuous, elastomeric waistband attached thereto. The waistband likewise resembles a conventional undergarment waistband and includes a plurality spaced belt loops thereon.

To simulate the desired wearing style, a user wears the trousers in a conventional fashion. A belt is inserted through each of the belt loops on the waistband and is tightened to a comfortable position. Accordingly, the wearer will appear to be sporting conventional trousers that are positioned and secured below a conventional undergarment waistband. Furthermore, if the user is wearing conventional underwear beneath the trouser, it will not be pulled downwardly thereby.

It is therefore an object of the present invention to provide a trouser that, when worn, appears to be suspended beneath the wearer's underpants.

It is another object of the present invention to provide a trouser that simulates a unique wearing style without incurring the problems associated therewith.

Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
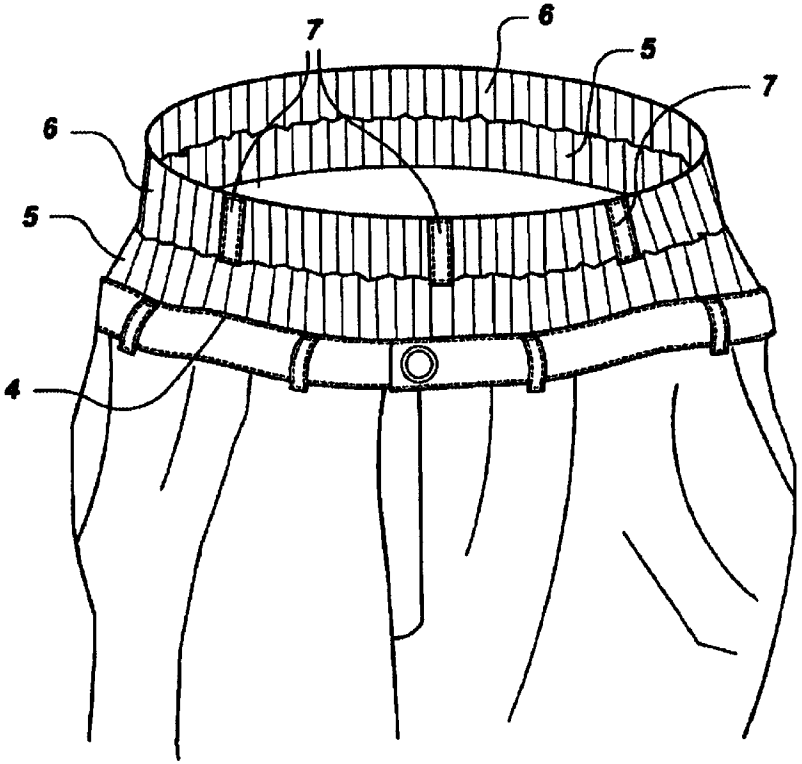
FIG. 2 is a perspective view of the waist section of the trouser and the attached elastomeric bands.
Figure 1:
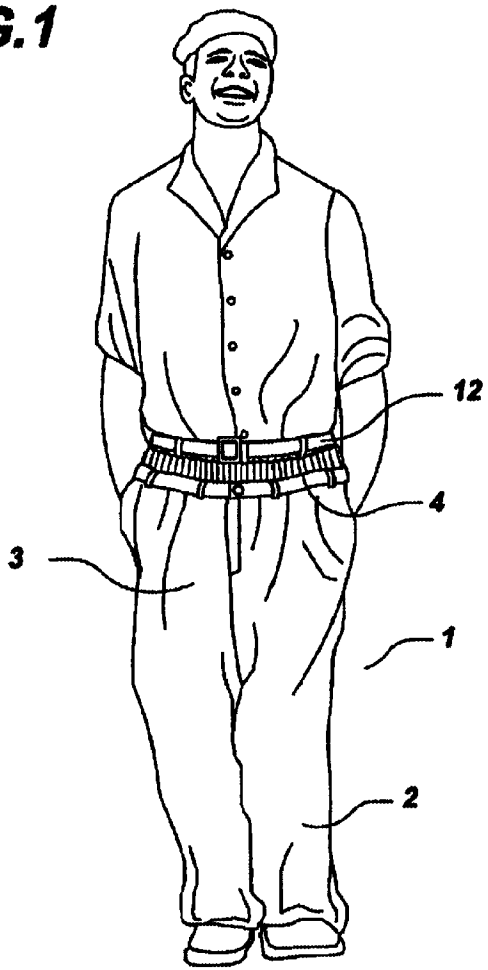
FIG. 1 is a perspective view of the trouser being worn by a user.

Referring now to FIGS. 1 and 2, the present invention relates to an improved trouser. The device comprises a trouser member 1 having a pair of elongated legs portions 2 depending from a pelvic section 3. The pelvic section includes a waist section that terminates at an upper circumferential edge 4. Extending upwardly from the upper edge of the waist section is a lower elastomeric band 5 configured to resemble an undergarment waistband. The lower elastomeric band includes a continuous upper edge having a continuous, elastomeric waistband 6 attached thereto. The waistband resembles a conventional undergarment waistband and includes a plurality spaced belt loops 7 thereon for slidably receiving a belt 12.

To simulate the desired wearing style, a user wears the trousers in a conventional fashion. A belt is inserted through each of the belt loops on the waistband and is tightened to a comfortable position. Accordingly, the wearer will appear to be sporting conventional trousers that are positioned and secured below a conventional undergarment waistband. Furthermore, if a user is wearing conventional underwear beneath the trouser, it will not be pulled downwardly thereby.

The above described trouser is not limited to the exact details of construction and enumeration of parts provided herein. Though the device is primarily depicted and described as a man's trouser, the concept could also be extended to a ladies' trouser if desired. Each of the bands could be configured to resemble any type of undergarment waistband. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A trouser comprising:

a pelvic section having a pair of leg portions depending therefrom, said pelvic section terminating at a waist section, said waist section having an upper circumferential edge;

a lower elastomeric band circumferentially attached to the upper edge of the waist section and extending upwardly therefrom so as to be exposed when said trouser is worn by a user, said lower band configured to resemble an undergarment waistband.

2. The trouser according to claim 1 wherein said lower, elastomeric band includes an upper continuous edge having an upper, elastomeric waistband circumferentially secured thereto for encompassing a wearer's waist.

3. The trouser according to claim 2 wherein said waistband includes a plurality of belt loops thereon each for slidably receiving a belt to secure said trouser to a wearer.

4. The trouser according to claim 3 wherein said waistband is configured to resemble an undergarment waistband.

* * * * *